US008147140B2

(12) United States Patent
Williams et al.

(10) Patent No.: US 8,147,140 B2
(45) Date of Patent: Apr. 3, 2012

(54) BAG WITH FLEXIBLE RIM TO FACILITATE STRUCTURAL SUPPORT

(76) Inventors: Matthew E. Williams, Canton, GA (US); Danee' L. Williams, Canton, GA (US)

( * ) Notice: Subject to any disclaimer, the term of this patent is extended or adjusted under 35 U.S.C. 154(b) by 297 days.

(21) Appl. No.: 12/505,598

(22) Filed: Jul. 20, 2009

(65) Prior Publication Data

US 2011/0013857 A1 Jan. 20, 2011

(51) Int. Cl.
*B65D 33/00* (2006.01)
*B65D 33/06* (2006.01)
*B65D 30/00* (2006.01)

(52) U.S. Cl. ..... 383/33; 383/25; 383/37

(58) Field of Classification Search ..... 383/33, 383/37, 72, 75, 25, 70, 71
See application file for complete search history.

(56) References Cited

U.S. PATENT DOCUMENTS

| | | | | | |
|---|---|---|---|---|---|
| 3,079,966 | A * | 3/1963 | Kugler | 383/75 |
| 3,150,813 | A * | 9/1964 | Wellman | 383/89 |
| 3,353,662 | A * | 11/1967 | Pickin | 206/390 |
| 3,403,410 | A * | 10/1968 | Benzel et al. | 4/144.2 |
| 3,578,236 | A * | 5/1971 | Arai | 383/33 |
| 3,674,135 | A * | 7/1972 | Simon | 206/225 |
| 3,889,871 | A * | 6/1975 | White | 383/203 |
| 4,138,932 | A * | 2/1979 | Mowli et al. | 493/195 |
| 4,394,955 | A * | 7/1983 | Raines et al. | 383/86 |
| 4,810,103 | A * | 3/1989 | Bell | 383/70 |
| 5,346,311 | A * | 9/1994 | Siler et al. | 383/75 |
| 6,290,392 | B1 * | 9/2001 | Sandor | 383/33 |
| 6,302,583 | B1 * | 10/2001 | Steinmetz | 383/33 |
| 6,695,476 | B2 | 2/2004 | Jackson et al. | |
| 7,077,796 | B2 | 7/2006 | Rusnak et al. | |
| 2006/0280386 | A1 * | 12/2006 | Bublitz | 383/33 |

FOREIGN PATENT DOCUMENTS

FR 2567103 A1 * 1/1986

OTHER PUBLICATIONS

Translation of French Document No. 2 567 103 to Sevestre. Translated Jul. 2011.*

* cited by examiner

*Primary Examiner* — Jes F Pascua
(74) *Attorney, Agent, or Firm* — Bradley D. Crose; Crose Law LLC

(57) ABSTRACT

A bag having both a support system and a closure system is provided. The closure system of the bag provides structural support to the bag. In at least one embodiment, the bag includes at least one sheet of flexible material assembled to form a semi-enclosed container, an opening within the semi-enclosed container defined by a generally circular periphery of the semi-enclosed container at an unenclosed end of the at least one sheet of flexible material, and a flexible support rim disposed around the generally circular periphery of the semi-enclosed container at an unenclosed end. The support rim is sufficient to support the opening within the semi-enclosed container in an open position.

9 Claims, 5 Drawing Sheets

BAG WITH FLEXIBLE RIM TO FACILITATE STRUCTURAL SUPPORT

FIELD OF THE INVENTION

The technology described herein relates generally to bags, such as trash bags, yard waste bags, bags for pet litter boxes, and the like, commonly used to contain and dispose of various waste items. More specifically, this technology relates to bags having both a support system and a closure system, wherein the closure system provides structural support to the bag.

BACKGROUND OF THE INVENTION

Bags such as trash bags, yard waste bags, bags for pet litter boxes, and the like, are commonly used to contain and dispose of various waste items. Such bags are often plastic and are produced and sold in a variety of sizes and shapes. The plastic bags in and of themselves do not provide support. Known plastics bags must be utilized in a support frame, such as a trash bin, frame, or the like, in order to be maintained and supported in an upright, or other, position.

Related patents known in the art include the following: U.S. Pat. No. 6,695,476, issued to Jackson et al. on Feb. 24, 2004, discloses a bag with extensible handles. U.S. Pat. No. 7,077,796, issued to Rusnak et al. on Jul. 18, 2006, discloses a bag with elastic strip and method of making the same.

The foregoing patent and other information reflect the state of the art of which the inventors are aware and are tendered with a view toward discharging the inventors' acknowledged duty of candor in disclosing information that may be pertinent to the patentability of the technology described herein. It is respectfully stipulated, however, that the foregoing patent and other information do not teach or render obvious, singly or when considered in combination, the inventors' claimed invention.

BRIEF SUMMARY OF THE INVENTION

In various exemplary embodiments, the technology described herein provides a bag having both a support system and a closure system, wherein the closure system provides structural support to the bag.

In one exemplary embodiment, the technology described herein provides a bag. The bag includes at least one sheet of flexible material assembled to form a semi-enclosed container, an opening within the semi-enclosed container defined by a generally circular periphery of the semi-enclosed container at an unenclosed end of the at least one sheet of flexible material, and a flexible support rim disposed around the generally circular periphery of the semi-enclosed container at an unenclosed end, wherein the support rim is sufficient to support the opening within the semi-enclosed container in an open position.

The bag can also include a rim channel disposed within the generally circular periphery of the semi-enclosed container at the unenclosed end of the at least one sheet of flexible material. In this embodiment, the flexible support rim is disposed with the rim channel.

The rim can further include a protective coating disposed upon the rim. The rim can further include a generally planar trim material disposed upon the rim to provide additional width and strength to the rim. The rim further can be manufactured from a lightweight, flexible wire product. Alternatively, the rim further can be manufactured from a lightweight, flexible plastic product.

In at least one embodiment, the rim and the generally circular periphery of the semi-enclosed container at an unenclosed end are integrally formed.

The bag can further include an external bag handle disposed on an exterior of the at least one sheet of flexible material.

The bag can further include at least one closure orifice defined within the generally circular periphery of the semi-enclosed container at an unenclosed end of the at least one sheet of flexible material. In this embodiment, the rim is pulled externally through the closure orifice to tighten and to lessen a circumference of the generally circular periphery.

The rim can be configured to twist and tie-off the bag. Likewise, the rim can be configured to untwist and untie in order to reopen the bag.

In another exemplary embodiment, the technology described herein provides a thermoplastic bag for trash and lawn waste disposal. The thermoplastic bag for trash and lawn waste disposal includes a thermoplastic sheet material comprised of a front and rear wall continuously joined together along a bottom and side edges, an opening defined at the top along the top edges of the front and rear walls, and a flexible support rim disposed along the top edges of the front and rear walls. In this embodiment, the support rim is sufficient to support the thermoplastic bag for trash and lawn waste in an open position.

The thermoplastic bag for trash and lawn waste disposal can also include a protective coating disposed upon the rim. The thermoplastic bag for trash and lawn waste disposal can also include a generally planar trim material disposed upon the rim to provide additional width and strength to the rim.

The thermoplastic bag for trash and lawn waste disposal can include a rim channel disposed within the top edges of the front and rear walls. In this embodiment, the flexible support rim is disposed with the rim channel.

The thermoplastic bag for trash and lawn waste disposal can further include at least one closure orifice defined within the top edges of the front and rear walls. In this embodiment, the rim is pulled externally through the closure orifice to tighten and to lessen a circumference of the thermoplastic bag.

The rim and the top edges of the front and rear walls can be integrally formed. The rim can further be manufactured from a lightweight, flexible plastic product. Alternatively, the rim can further be manufactured from a lightweight, flexible wire product.

In another exemplary embodiment, the technology described herein provides a thermoplastic bag roll. The thermoplastic bag roll includes a plurality of thermoplastic bags, each bag comprised of a front and rear wall continuously joined together along a bottom and side edges, an opening defined at the top along the top edges of the front and rear walls, and a flexible support rim disposed along the top edges of the front and rear walls, wherein the support rim is sufficient to support the thermoplastic bag for trash and lawn waste in an open position, and wherein the support rim is collapsible and rollable.

In this embodiment, the plurality of thermoplastic bags and each flexible support rim disposed within each bag is rolled. The plurality of thermoplastic bags is formed from a front and a rear thermoplastic sheet and perforated for use in a dispenser. The flexible support rim in each thermoplastic bag is formed from a front and rear flexible support wire cut as the thermoplastic bags are perforated.

Thus, advantages of the technology described herein include the ability to utilize a bag, such as a trash bag, yard waste bag, bag for a pet litter box, or the like, to contain and dispose of various waste items, without the need to provide a support frame or trash bin to hold the bag open. Advantageously, the bag disclosed herein has both a support system and a closure system, wherein the closure system provides the structural support to the bag. Also advantageously, a user of the bag disclosed herein can operate the bag single-handedly to move the bag while having it remain in a supported form. Further advantageously, the bag can be supported with the bag opening in a supported, open form without the need of a support frame or trash bin, allowing a user, for example, to rake yard waste into such a bag lying on its side, yet open. Still further advantageously, the bag disclosed herein can be inserted into a trash bin, or the like, and secured with the rim such that no slipping occurs.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a bag having both a support system and a closure system, wherein the closure system provides structural support to the bag.

Referring now to the Figures a rim bag 10 is shown. The rim bag 10 is formed of at least one sheet of flexible material 18 assembled to form a semi-enclosed container with opening 12. The opening 12 within the semi-enclosed container is defined by a generally circular periphery at an unenclosed end. In at least one embodiment the sheet of flexible material 18 is a thermoplastic sheet material, as known in the art.

The rim bag 10 further includes a flexible support rim 14 disposed around the generally circular periphery of the semi-enclosed container bag. The support rim 14 is sufficient to support the generally circular periphery of the opening 12 and keep the bag 10 in an open position. While open, items such as trash, yard waste, and the like can be entered through opening 12 into the bag 10 without requiring a two-handed user operation to maintain the bag 10 in an open position.

Figure 1:
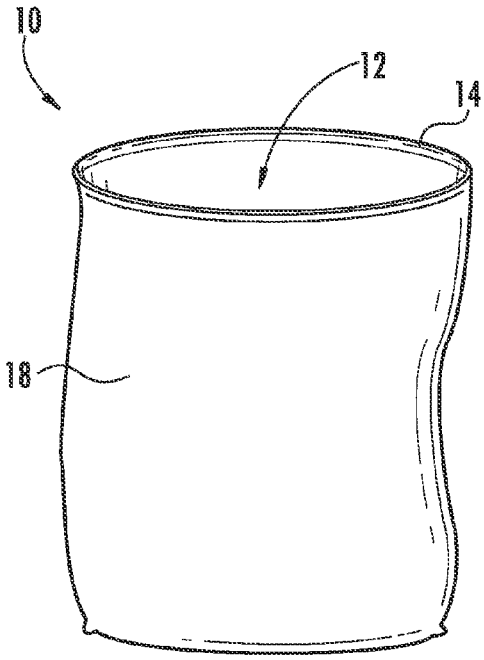
FIG. 1 is a front perspective view of a rim bag, according to an embodiment of the technology described herein, illustrating, in particular, the rim bag in an upright position.
Figure 2:
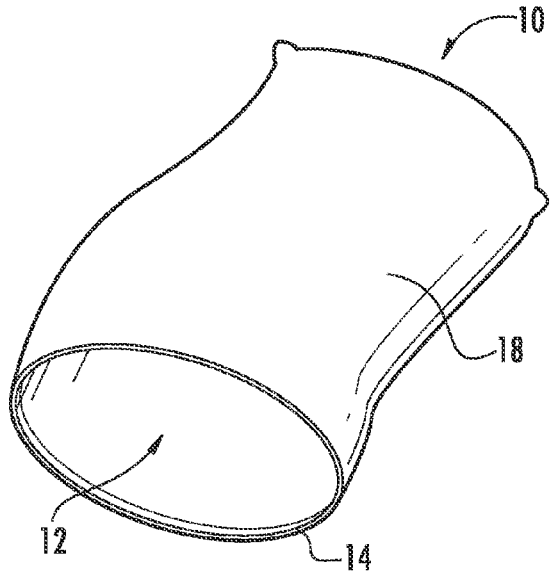
FIG. 2 is a front perspective view of the rim bag depicted in FIG. 1, illustrating, in particular, the rim bag in a position on its side for use according to an embodiment of the technology described herein.

Referring now specifically to FIGS. 1 and 2, front perspective views of a rim bag 10 are shown. In FIG. 1, the rim bag 10 is illustrated in an upright position, as it might be for insertion into a bin, or the like, and the rim 14 subsequently tightened to prevent slippage of the bag 10. In FIG. 2, the rim bag 10 is illustrated in a position on its side, as it might be in a free-standing format for use in a lawn to collect yard waste, and the like, by a user. In at least one embodiment, the rim 14 and the bag 10 are integrally formed.

The rim 14 is configured to be lightweight and flexible such that it provides structural support to the rim bag 10, but also does not add significant weight or rigidity to the overall bag 10. Additionally, the rim 14 of the rim bag 10 is configured to hold its form and shape at the opening 12 while untouched by an operator, and yet yield and bend to the direction of an operator to change the shape of opening 12 or to tighten the rim 14 or two twist the rim 14 to hold it securely.

Figure 3:
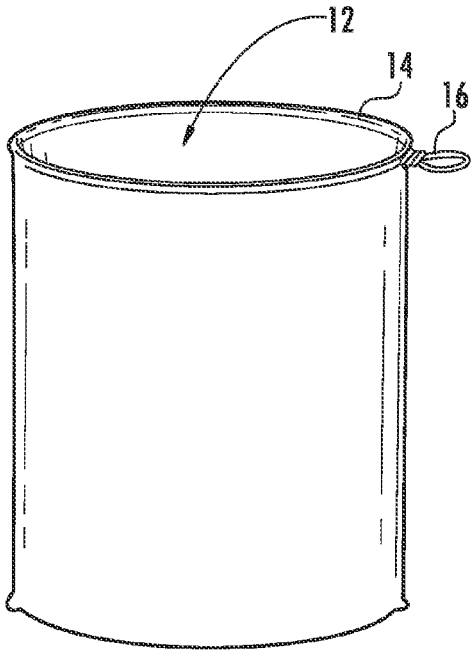
FIG. 3 is a front perspective view of the rim bag depicted in FIG. 1, illustrating, in particular, the rim bag in an upright position and with the rim pulled, twisted, and thereby tightened to hold the rim bag securely in an upright position such as that within a cylindrical bin.

Referring now to FIG. 3, a front perspective view of the rim bag 10 is shown, illustrating, in particular, the rim bag 10 in an upright position and with the rim 14 pulled, twisted into position 16, and thereby tightened to hold the rim bag 10 securely in an upright position such as that within a cylindrical trash bin, support frame, or the like.

Figure 4:
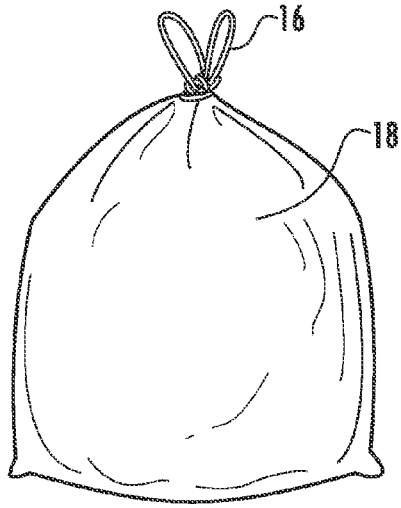
FIG. 4 is a front perspective view of the rim bag depicted in FIG. 1, illustrating, in particular, the rim bag full of refuse, or the like, and the flexible rim drawn tightly, twisted, and secured to close the rim bag and maintain the refuse within.

Referring now to FIG. 4 a front perspective view of the rim bag 10 is shown, illustrating, in particular, the rim bag 10 full of refuse, or the like, and the flexible rim 14 drawn tightly, twisted into position 16, and secured to close the rim bag 10 and maintain the refuse within.

The rim 14 can be manufactured from a lightweight, flexible wire product. Alternatively, the rim 14 can be manufactured from a lightweight, flexible plastic product. As will be apparent to those of ordinary skill in the art, the material or materials of which the rim 14 is manufactured can vary, so long as the material is strong enough to support the opening 12 of the bag 10 in an open position. Additionally, as will be apparent to those of ordinary skill in the art, the size, width, coatings, or lack thereof, of the rim 14 can vary.

The rim bag 10 can further include a rim channel 24, as shown in FIGS. 6, 6A, 7, 7A, disposed within the rim bag 10. By way of example, the rim channel 24 can be located at the generally circular periphery of the semi-enclosed container at the unenclosed end of the at least one sheet of flexible material. The flexible support rim 14 is disposed with the rim channel 24 in order to secure the rim bag 10 in an open position or closed position when desired by an operator.

Figure 6:
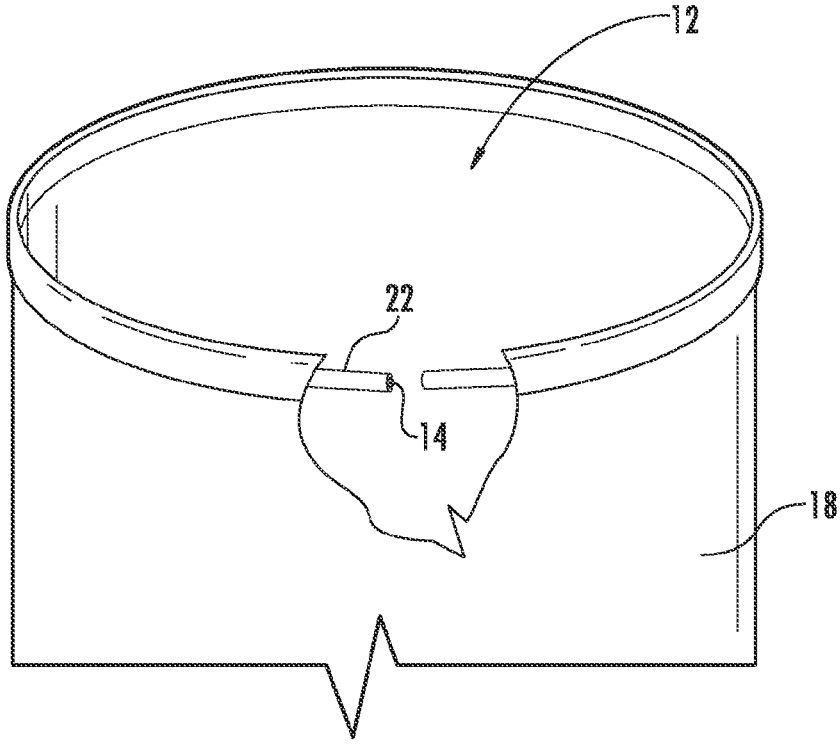
FIG. 6 is a front perspective view of a rim bag, illustrating, in particular, a rim having a coating and placed within a rim channel of the bag, according to an embodiment of the technology described herein.
Figure 6A:
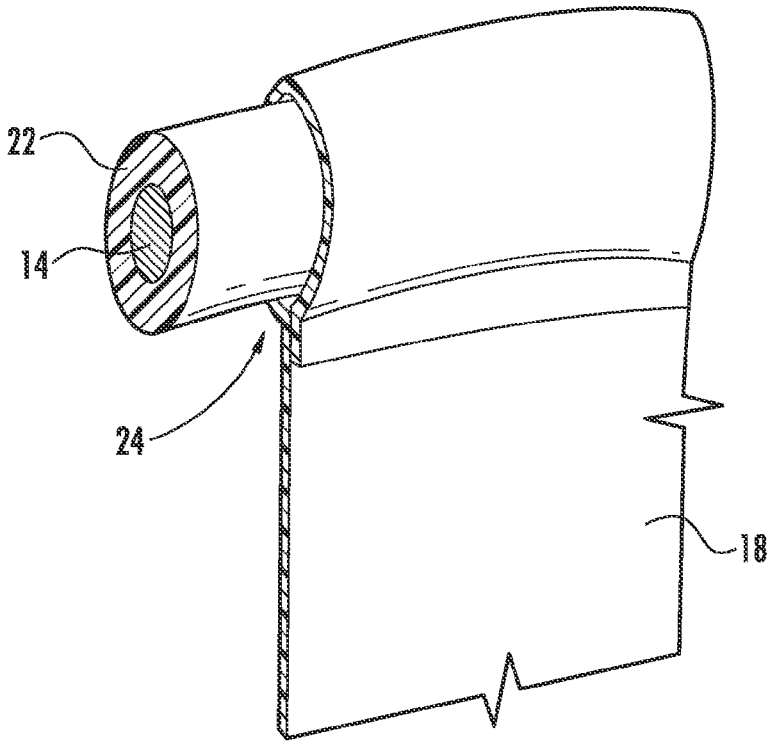
FIG. 6A is a close up front perspective view of the rim bag, rim, and rim channel depicted in FIG. 6.

The rim 14 can further include a protective coating 22 disposed upon the rim 14, or integrally formed with the rim 14. By way of example, in one embodiment, the rim is manufactured from a flexible, metal wire, to provide support and structure, and the protective coating is a thin plastic material to cover the metal wire. Referring now to FIGS. 6, 6A a front perspective view of a rim bag 10 is shown, illustrating, in particular, a rim 14 having a coating 22.

The rim 14 can further include a generally planar trim material 26 disposed upon the rim 14 to provide additional width and strength to the rim. The generally planar trim material 26 can enable the rim 14 to be easily twisted and tied. The generally planar trim material 26 enables the rim 14 to be held securely in place when tightened. As the generally planar trim material 26 is twisted, tightened, or otherwise pulled, the generally planar trim material 26 exits the rim channel 24 at orifice 28 such that it is exterior to the bag 10 and accessible by an operator. The degree to which the rim 14 is exited through orifice 28 is operatively selected by the user dependent on how tight or what form the bag 10 is to take in its use.

Figure 7:
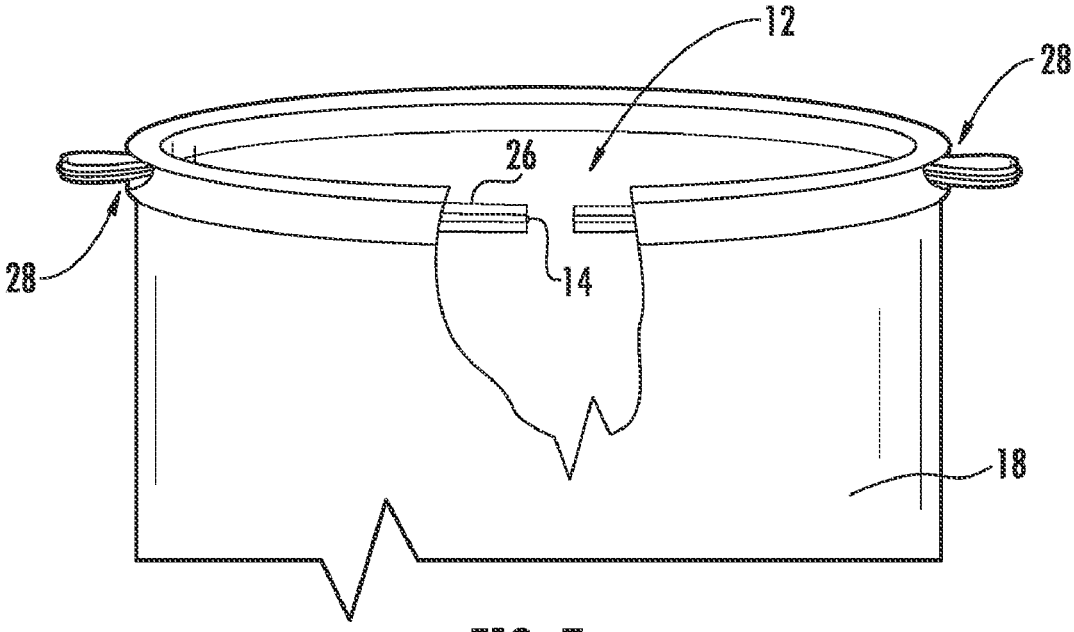
FIG. 7 is a front perspective view of a rim bag, illustrating, in particular, a rim having a rim trim coating and placed within a rim channel of the bag, according to an embodiment of the technology described herein.
Figure 7A:
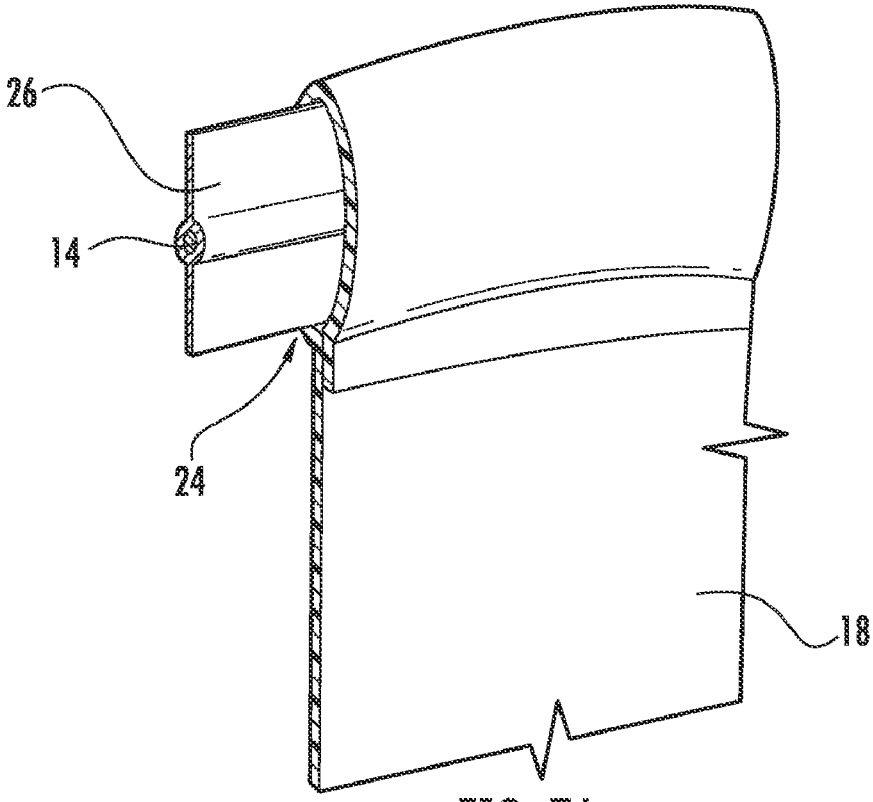
FIG. 7A is a front perspective view of a close up front perspective view of the rim bag, rim, and rim channel depicted in FIG. 7.

Referring now to FIGS. 7, 7A a front perspective view of a rim bag 10 is shown illustrating, in particular, a rim 14 having a rim trim coating, such as generally planar trim material 26, and placed within a rim channel 24 of the rim bag 10. As the rim 14 is pulled and twisted, tied, etc., the rim 14 having the generally planar trim material 26 is pulled through one or more orifice 28 in the rim channel 24 to provide an external handle to twist and tie the bag 10. Position 16 illustrates a handle formed by pulling and twisting the rim 14. Additionally, a handle can be added to the bag 10 itself.

The closure orifice 28 is defined within the generally circular periphery of the semi-enclosed container at an unenclosed end of the at least one sheet of flexible material 18. As will be apparent to one of ordinary skill in the art, the size, number, and location of each orifice 28 can vary. In use the rim 14 is pulled externally through the closure orifice 28 to tighten and to lessen a circumference of the generally circular periphery, and thus secure or otherwise tighten the bag.

As such, the bag 10 is easily reopened by untwisting the rim 14 and reopening the bag 10. This overcomes known deficiencies with thermoplastic bags that are tied off with thermoplastic handles integrally formed with the bag or with thermoplastic bags having thermoplastic drawstrings. Such bags are not readily or easily untied.

In use, the rim bag 10 provides a user with the ability to support a bag 10, such as a trash bag, yard waste bag, bag for a pet litter box, or the like, to contain and dispose of various waste items without the need for an external support means such as a trash bin or a support frame to hold the bag 10 open. The bag 10 has both a support system and a closure system, wherein the closure system provides the structural support to the bag. A user can operate the bag 10 single-handedly to move the bag 10 while having it remain in a supported form.

Figure 8:
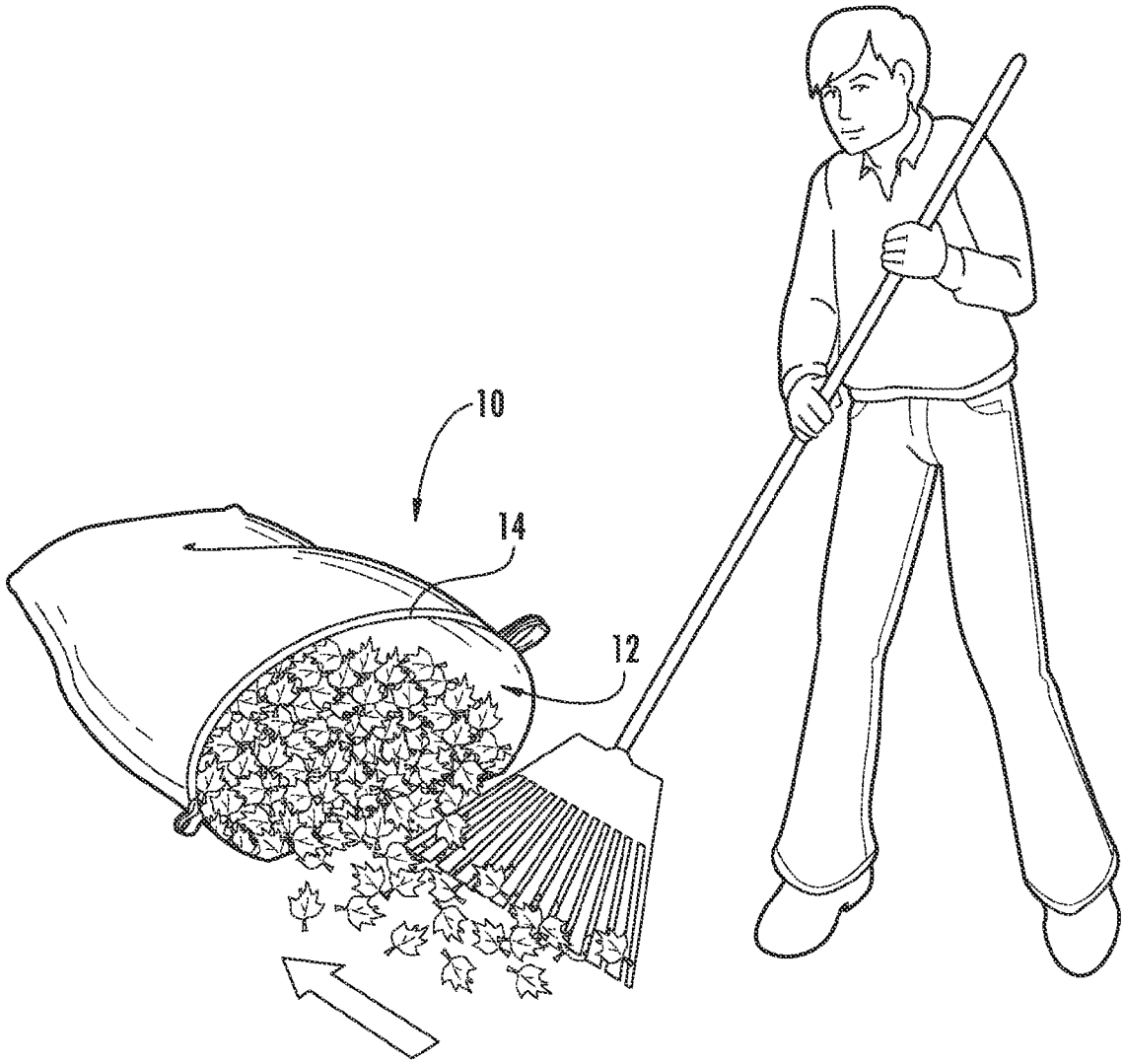
FIG. 8 is a front perspective view of the rim bag, illustrating, in particular, use of the rim bag supported open and on its side by the flexible rim, according to an embodiment of the technology described herein.

The rim 14 of the rim bag 10 can be formed to provide a sufficient opening 12 such that one can, for example, place the bag 10 on its side and rake leaves, or other yard waste into the bag. Referring now to FIG. 8, a front perspective view of the rim bag 10 is shown, illustrating, in particular, use of the rim bag 10 supported open and on its side by the flexible rim 14 such that leaves are raked into the bag without the bag being held or supported in a bin or frame.

An alternative use of the rim bag 10 includes lining a pet litter box and securing the bag 10 with rim 14. Additionally, an alternative use includes utilizing the rim bag 10 as a cover for bushes, such as weather sensitive rose bushes, or for a grill cover, or the like.

In one embodiment, the rim bag 10 is packaged in a thermoplastic roll 20. The thermoplastic bag roll 20 includes a plurality of thermoplastic bags 10. Each bag 10 includes a front and rear wall continuously joined together along a bottom and side edges, an opening 12 defined at the top along the top edges of the front and rear walls, and a flexible support rim 14 disposed along the top edges of the front and rear walls. The support rim is 14 sufficient to support the thermoplastic bag 10 for trash and lawn waste in an open position, yet the support rim 14 is collapsible and rollable for storage in a thermoplastic roll 20 for sales, distribution, and use.

In this embodiment, the plurality of thermoplastic bags 10 and each flexible support rim 14 disposed within each bag 10 is rolled. The plurality of thermoplastic bags 10 is formed from a front and a rear thermoplastic sheet 18 and perforated for use in a dispenser. The flexible support rim 14 in each thermoplastic bag 10 is formed from a front and rear flexible support wire cut as the thermoplastic bags 10 are perforated.

Figure 5:
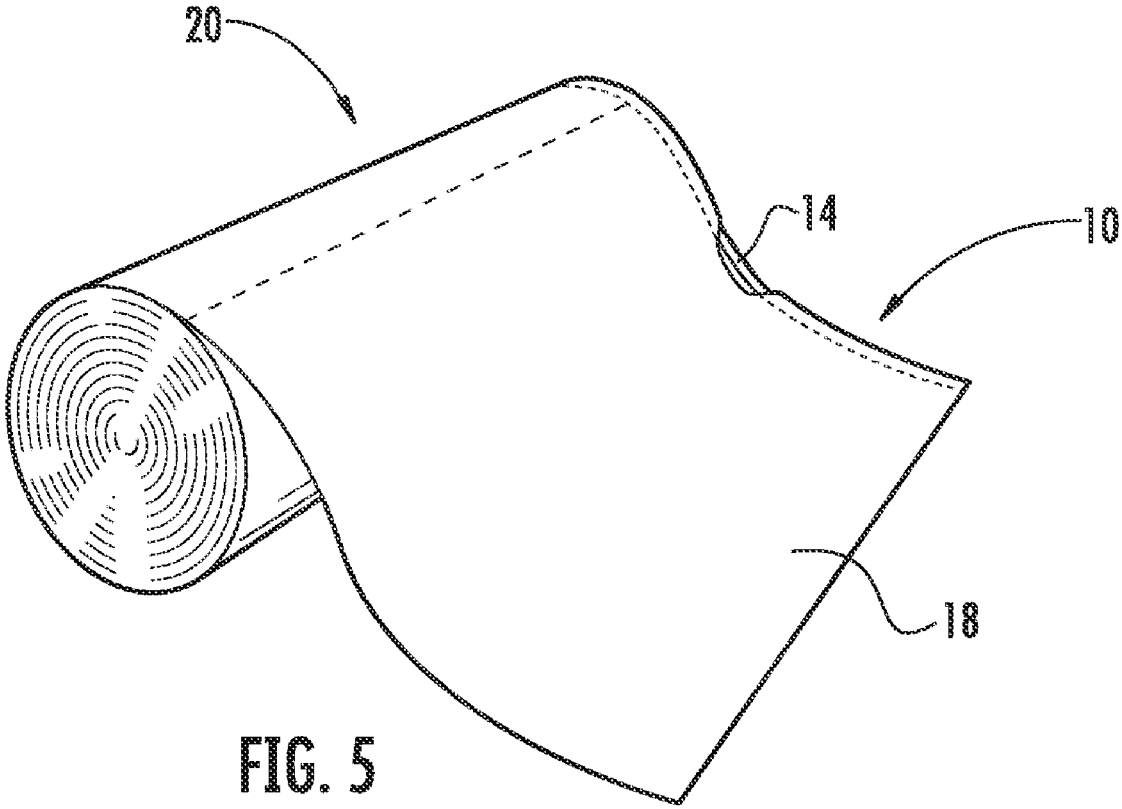
FIG. 5 is a front perspective view of a roll of rim bags, illustrating, in particular, a perforation line to separate one rim bag from another in the roll, according to an embodiment of the technology described herein.

Referring now to FIG. 5, a thermoplastic bag roll 20 is shown, illustrating, in particular, a plurality of rim bags 10, the rim 14, and the thermoplastic sheet material 18, and the perforation line separating each bag 10 from one another.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A thermoplastic bag for trash and lawn waste disposal comprising:

a thermoplastic sheet material comprised of a front and rear wall continuously joined together along a bottom and side edges;

an opening defined at the top along the top edges of the front and rear walls;

a flexible support rim in the form of a continuous loop and of generally a same length as the front and rear walls continuously joined together, disposed along the top edges of the front and rear walls, wherein the support rim is sufficient to support the thermoplastic bag for trash and lawn waste in an open position;

a rim channel disposed within the top edges of the front and rear walls, wherein the flexible support rim is disposed with the rim channel; and at least one closure orifice defined within the top edges of the front and rear walls, wherein the rim is pulled externally through the closure orifice to tighten and to lessen a circumference of the thermoplastic bag.

2. The thermoplastic bag of claim 1, further comprising:

a protective coating disposed upon the rim.

3. The thermoplastic bag of claim 1, further comprising:

a generally planar trim material disposed upon the rim to provide additional width and strength to the rim.

4. The thermoplastic bag of claim 1, wherein the rim further comprises a lightweight, flexible plastic product.

5. The thermoplastic bag of claim 1, wherein the rim further comprises a lightweight, flexible wire product.

6. The thermoplastic bag of claim 1, wherein the rim is configured to twist and tie-off the bag, and wherein the rim is configured to untwist and untie in order to reopen the bag.

7. The thermoplastic bag of claim 1, wherein the rim is pulled externally through the closure orifice to tighten and to lessen a circumference of the generally circular periphery.

8. A thermoplastic bag roll comprising:

a plurality of thermoplastic bags, each bag comprised of a front and rear wall continuously joined together along a bottom and side edges, an opening defined at the top along the top edges of the front and rear walls, and a flexible support rim in the form of a continuous loop and of generally a same length as the front and rear walls continuously joined together disposed along the top edges of the front and rear walls; a rim channel disposed within the top edges of the front and rear walls, wherein the flexible support rim is disposed with the rim channel; and at least one closure orifice defined within the top edges of the front and rear walls, wherein the rim is pulled externally through the closure orifice to tighten and to lessen a circumference of the thermoplastic bag, wherein the support rim is sufficient to support the thermoplastic bag for trash and lawn waste in an open position, and wherein the support rim is collapsible and rollable;

wherein the plurality of thermoplastic bags and each flexible support rim disposed within each bag is rolled; and wherein the plurality of thermoplastic bags is formed from a front and a rear thermoplastic sheet and perforated for use in a dispenser.

9. The thermoplastic bag roll of claim 8, further comprising:

wherein the flexible support rim in each thermoplastic bag is formed from a front and rear flexible support wire cut as the thermoplastic bags are perforated.

* * * * *